US009546058B2

(12) United States Patent
Mitsui et al.

(10) Patent No.: US 9,546,058 B2
(45) Date of Patent: Jan. 17, 2017

(54) STACKING DEVICE AND IMAGE FORMING APPARATUS

(71) Applicant: CANON KABUSHIKI KAISHA, Tokyo (JP)

(72) Inventors: Yuji Mitsui, Susono (JP); Yuya Yanagi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/667,957

(22) Filed: Mar. 25, 2015

(65) Prior Publication Data

US 2015/0284196 A1 Oct. 8, 2015

(30) Foreign Application Priority Data

Apr. 2, 2014 (JP) ..... 2014-076286

(51) Int. Cl.
*B65H 1/04* (2006.01)

(52) U.S. Cl.
CPC ..... *B65H 1/04* (2013.01); *B65H 2405/1124* (2013.01); *B65H 2405/361* (2013.01)

(58) Field of Classification Search
CPC ..... B65H 1/04; B65H 2405/1142; B65H 2405/11425; B65H 2405/1144; B65H 2405/13; B65H 2405/36; B65H 2405/361; B65H 2701/122; B65H 2701/1315; B65H 2701/1322; B65H 2405/1117; B65H 2405/1124

(Continued)

(56) References Cited

U.S. PATENT DOCUMENTS 7,712,734 B2 * 5/2010 Kang ..... B65H 1/04 271/162
7,869,104 B2 1/2011 Murakami
2007/0222136 A1 9/2007 Murakami

FOREIGN PATENT DOCUMENTS

CN 1891594 A 1/2007
JP 2007-254074 A 10/2007

(Continued)

OTHER PUBLICATIONS

Copending unpublished U.S. Appl. No. 14/548,496, filed Nov. 20, 2014, to Masafumi Monde et al.

(Continued)

*Primary Examiner* — Michael McCullough
(74) *Attorney, Agent, or Firm* — Fitzpatrick, Cella, Harper & Scinto

(57) ABSTRACT

A stacking device includes: a first stacking portion having a stacking surface on which a sheet is stacked; a widthwise direction regulating unit, provided movably relative to the first stacking portion in a widthwise direction of the sheet, for regulating a widthwise position of the sheet stacked on the stacking surface; a second stacking portion provided rotatably relative to the first stacking portion between a first position and a second position. The second stacking portion is overlaid on the first stacking portion at the first position and supports, at the second position, an upstream portion of the sheet with respect to a feeding direction of the sheet fed by a sheet feeding unit. The second stacking portion is provided with a cut-away portion to avoid interference with the widthwise direction regulating unit when rotates between the first position and the second position.

9 Claims, 8 Drawing Sheets

(58) Field of Classification Search
USPC ..... 271/9.09, 171
See application file for complete search history.

(56) References Cited

FOREIGN PATENT DOCUMENTS

| | | | |
|---|---|---|---|
| JP | 2008-133103 | A | 6/2008 |
| JP | 2013-014408 | A | 1/2013 |

OTHER PUBLICATIONS

Chinese Office Action issued in corresponding Chinese Application No. 201510154398.9 dated Nov. 2, 2016.

* cited by examiner (a)

(b)

(a)

(b)

(a)

(b)

STACKING DEVICE AND IMAGE FORMING APPARATUS

FIELD OF THE INVENTION AND RELATED ART

The present invention relates to a stacking device and an image forming apparatus including the stacking device.

In general, an image forming apparatus, such as a copying machine or a printer, for feeding sheets one by one from a sheet feeding cassette accommodating a plurality of sheets toward an image forming portion has been known. Further, an image forming apparatus constituted so as to meet sheets having various sizes by enabling a sheet, having a size in which the sheet cannot be accommodated in the sheet feeding cassette, to be feedable from a manual feeding tray (manual by-pass tray) has been known.

A manual feeding tray which includes a main tray rotatably supported by a main assembly of the image forming apparatus and an auxiliary tray rotatably supported by the main tray and which is compact and capable of stacking sheets long in a sheet feeding direction has been conventionally proposed (Japanese Laid-Open Patent Application (JP-A) 2013-14408 and JP-A 2007-254074). The auxiliary tray is constituted so as to be held in a folded attitude such that the auxiliary tray is overlaid on an upper surface of the main tray and a developed attitude such that the auxiliary tray is developed along the sheet feeding direction.

Further, a feeding device such that a sheet feeding tray on which sheets are stacked is provided with a sheeting guide movable in a widthwise direction of the sheet and by the sheet guide, the widthwise direction of the sheet is regulated has been proposed (JP-A 2008-133103). On the sheet guide, a pressing member for pressing the sheet from above is provided, so that curling of the sheet is corrected.

The manual feeding tray described in JP-A 2013-14408 or JP-A 2007-254074 is not provided with the sheet guide as described in JP-A 2008-133103, but even in the case where the sheet is fed from the manual feeding tray, when the sheet is properly oriented (aligned) by the sheet guide, it is possible to prevent improper feeding such as oblique feeding. However, in the case where the main tray described in, e.g., JP-A 2013-14408 or JP-A 2007-254074 is provided with the sheet guide, it would be considered that when the auxiliary tray is placed in the folded attitude, the auxiliary tray interferes with the sheeting guide and thus the sheet guide constitutes an obstacle to rotation of the auxiliary tray. Further, there is a liability that also a member, disposed on the sheet guide, such as the pressing member described in JP-A 2008-133103 constitutes an obstacle to rotation of the auxiliary tray.

SUMMARY OF THE INVENTION

A principal object of the present invention is to provide a stacking device in which a second stacking means (unit) rotatably supported by a first stacking means (unit) is provided with a cut-away portion so as not to constitute an obstacle to rotation of the second stacking means thereby to solve the above-described problem.

According to an aspect of the present invention, there is provided a stacking device for stacking a sheet fed by a sheet feeding unit, comprising: a first stacking portion having a stacking surface on which the sheet is stacked; a widthwise direction regulating unit, provided movably relative to the first stacking portion in a widthwise direction of the sheet, for regulating a widthwise position of the sheet stacked on the stacking surface; a second stacking portion provided rotatably relative to the first stacking portion between a first position and a second position, wherein the second stacking portion is overlaid on the first stacking portion at the first position and supports, at the second position, an upstream portion of the sheet with respect to a feeding direction of the sheet fed by the sheet feeding unit, wherein the second stacking portion is provided with a cut-away portion to avoid interference with the widthwise direction regulating unit when rotates between the first position and the second position.

These and other objects, features and advantages of the present invention will become more apparent upon a consideration of the following description of the preferred embodiments of the present invention taken in conjunction with the accompanying drawings.

DESCRIPTION OF THE EMBODIMENTS

First Embodiment

First Embodiment will be described initially. An image forming apparatus in this embodiment according to the present invention may be any apparatus, such as a copying machine, a printer, a facsimile machine or a multi-function machine of these machines, including a stacking device capable of feeding a sheet. In the following embodiments, description will be made using a laser beam printer 1 of an electrophotographic type in which four color toner images are formed.

Figure 1:
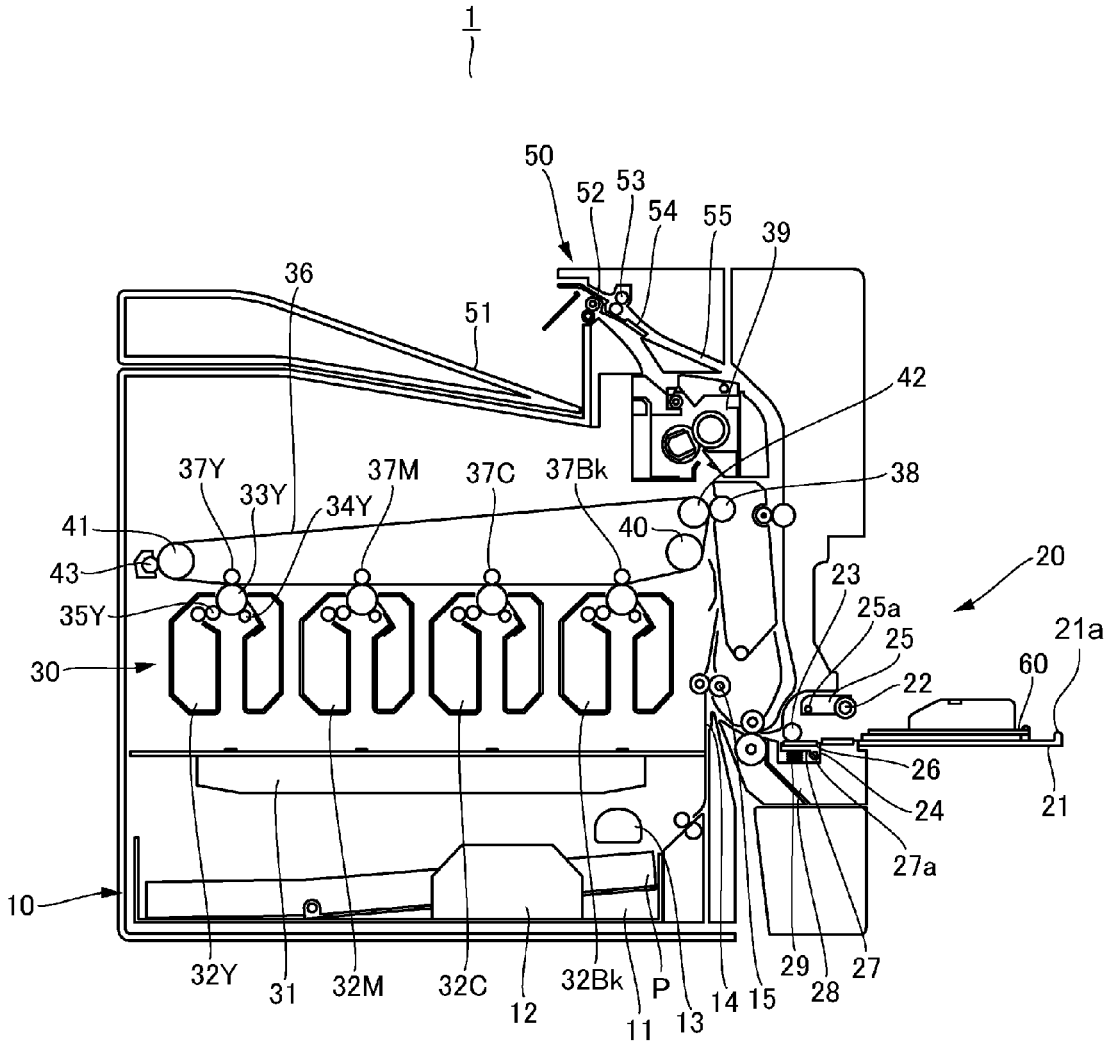
FIG. 1 is a general sectional view of a printer in First Embodiment of the present invention.

The printer 1 includes, as shown in FIG. 1, a cassette (type) feeding portion 10 for feeding sheets accommodated therein, a manual feeding portion 20 (sheet feeding device, stacking device) for feeding stacked sheets, an image forming portion 30 for forming an image on the sheet, and a discharging portion 50 for discharging the sheet to an outside of the printer 1.

The cassette feeding portion 10 includes a sheet stacking portion 11 where sheets P are stacked, a side regulating plate 12 for regulating a widthwise direction of the sheets P, and a feeding portion 13 for feeding the sheets P stacked on the sheet stacking portion 11 while separating the sheets P one by one. In this embodiment, only one stage of the cassette feeding portion is provided, but a plurality of stages of cassette feeding portions may also be provided so as to feed the sheets P different in size. Feeding timing of the sheet P fed by the feeding portion 13 is adjusted by a registration roller pair 15 on a feeding path 14.

The manual feeding portion 20 includes a feeding door 21, a manual feeding tray 60 fixed at an upper portion of the feeding door 21, a feeding roller 22 (feeding means) for feeding sheets on the manual feeding tray 60, a conveying roller 23, and a separating portion 24. The feeding door 21 is rotatably mounted, and is in an open state thereof in FIG. 1, but by closing the feeding door 21, the feeding door 21 can be held so as to be flush with one side surface of the printer 1. The feeding roller 22 is mounted at a free end portion of a holder 25 supported rotatably about a rotation shaft 25*a*. The separating portion 24 including a separating pad 26, a pad holder 27 for supporting the separating pad 26 rotatably about a shaft 27*a*, a separating frame 28, and a separating spring 29 held between the separating frame 28 and the pad holder 27. The separating pad 26 is urged toward the conveying roller 23 by the separating spring 29, and separates the sheets, one by one, fed by the feeding roller 22. The sheet passed through the conveying roller 23 and the separating pad 26 is fed toward the registration roller pair 15.

The image forming portion 30 includes an exposure device 31 and four process cartridges 32Y, 32M, 32C and 32Bk for forming images of four colors of yellow (Y), magenta (M), cyan (C) and black (K), respectively. The four process cartridges 32Y, 32M, 32C and 32Bk have the same constitution except that colors of the images formed are different from each other, and therefore the constitution of the process cartridge 32Y will be described, and the constitutions of the process cartridges 32M, 32C and 32Bk will be omitted from description. The process cartridge 32Y includes a photosensitive drum 33Y, a charging roller 34Y for electrically charging the photosensitive drum 33Y, and a developing roller 35Y for developing an electrostatic latent image formed on the photosensitive drum 33Y.

Further, the image forming portion 30 includes an intermediary transfer belt 36 onto which a toner image on the photosensitive drum (e.g., 33Y) of the associated process cartridge is primary-transferred, and primary transfer rollers 37Y, 37M, 37C and 37Bk for primary-transferring toner images onto the intermediary transfer belt 36. Further, the image forming portion 30 includes a secondary transfer roller 38 for secondary-transferring the primary-transferred toner images onto the sheet P, and a fixing portion 39 for heat-fixing the secondary-transferred toner images. The intermediary transfer belt 36 is wound around a driving roller 40 for driving the intermediary transfer belt 36, a tension roller 41 and a secondary transfer opposite roller 42 opposing the secondary transfer roller 38. In a side opposite to the tension roller 41 via the intermediary transfer belt 36, a cleaning means 43 for removing a tray, on the intermediary transfer belt 36, after passing through the secondary transfer roller 38 is provided. The discharging portion 50 includes a discharging roller 52 for discharging the sheet P onto a discharge tray 51, a reversing roller 53, a flapper 54 for selectively guiding the sheet P to the discharging roller 52 or the reversing roller 53, and a feeding path 55 for double-side printing.

When an image forming instruction is outputted to the printer 1, the exposure device 31 emits laser light toward the photosensitive drum (e.g., 33Y) of the associated process cartridge 32Y, 32M, 32C and 32Bk on the basis of inputted image information. At this time, the photosensitive drum is charged in advance by the charging roller (e.g., 34Y), and by the emission of the laser light, the electrostatic latent image is formed on the photosensitive drum. Thereafter, the electrostatic latent image is developed by the developing roller (e.g., 35Y), so that the toner images of yellow (Y), magenta (M), cyan (C) and black (Bk) are formed on the respective photosensitive drums. The respective color toner images formed on the associated photosensitive drums are transferred onto the intermediary transfer belt 36 by the primary transfer rollers 37Y, 37, 37C and 37Bk, and then are fed to the secondary transfer roller 38 by the intermediary transfer belt 36.

In parallel with the above-described image forming operation, the sheets accommodated in the cassette feeding portion 10 or the sheets stacked on the manual feeding portion 20 are fed one by one toward the registration roller pair 15. Then, onto the sheet fed at predetermined feeding timing by the registration roller pair 15, the toner images on the intermediary transfer belt 36 are transferred by the secondary transfer roller 38. The sheet on which the toner images are transferred is, after the toner images are fixed at the fixing portion 39, discharged onto the discharge tray 51 by the discharging roller 52.

In the case where the image is formed on double surfaces (first and second surfaces) of the sheet P, the sheet on which the image is formed on the first surface by the secondary transfer roller 38 is guided toward the reversing roller 53 by the flapper 54, so that sheet is turned upside down by the reversing roller 53, and thereafter the sheet is guided to the feeding path 55 for the double-side printing. Then, the sheet is fed again to the registration roller pair 15, and then the image is formed on the second surface by the secondary transfer roller 38, so that the sheet is discharged onto the discharge tray 51.

Figure 2:
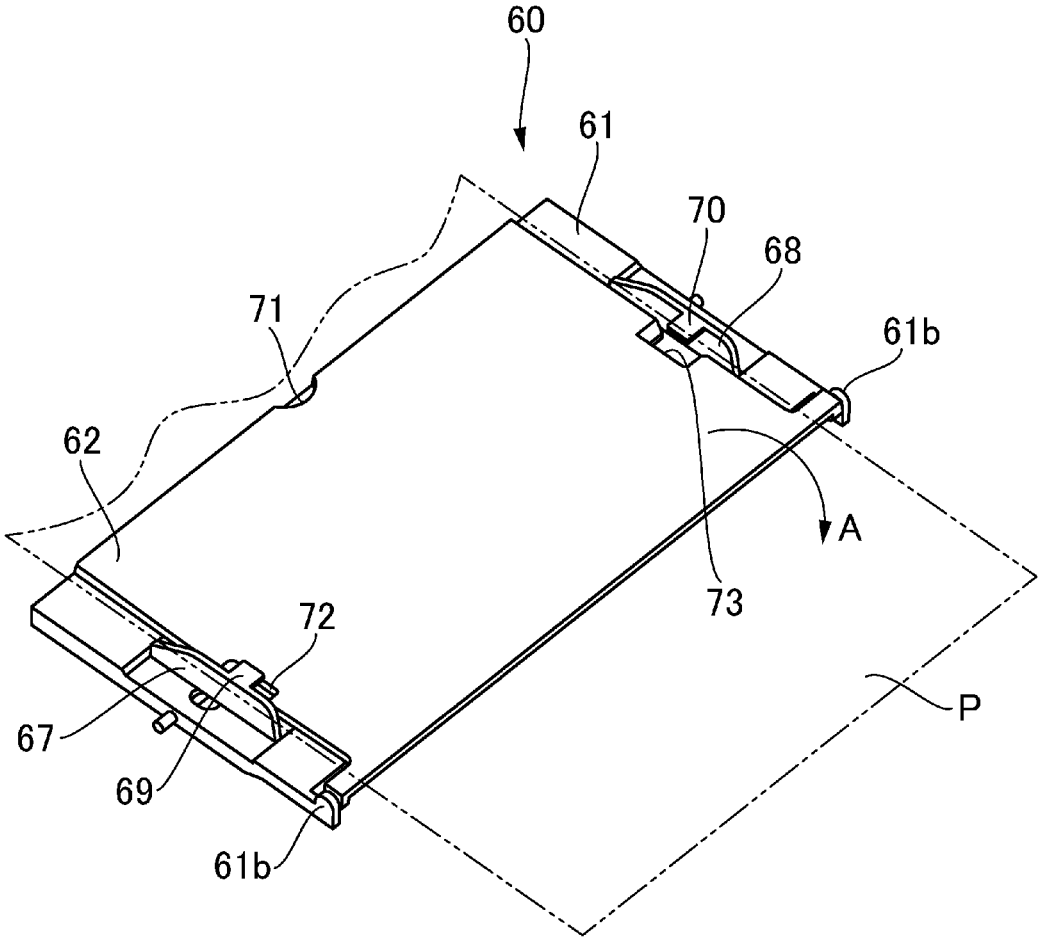
FIG. 2 is a perspective view of a manual feeding tray in a state in which an auxiliary tray is in a first position in First Embodiment.
Figure 3:
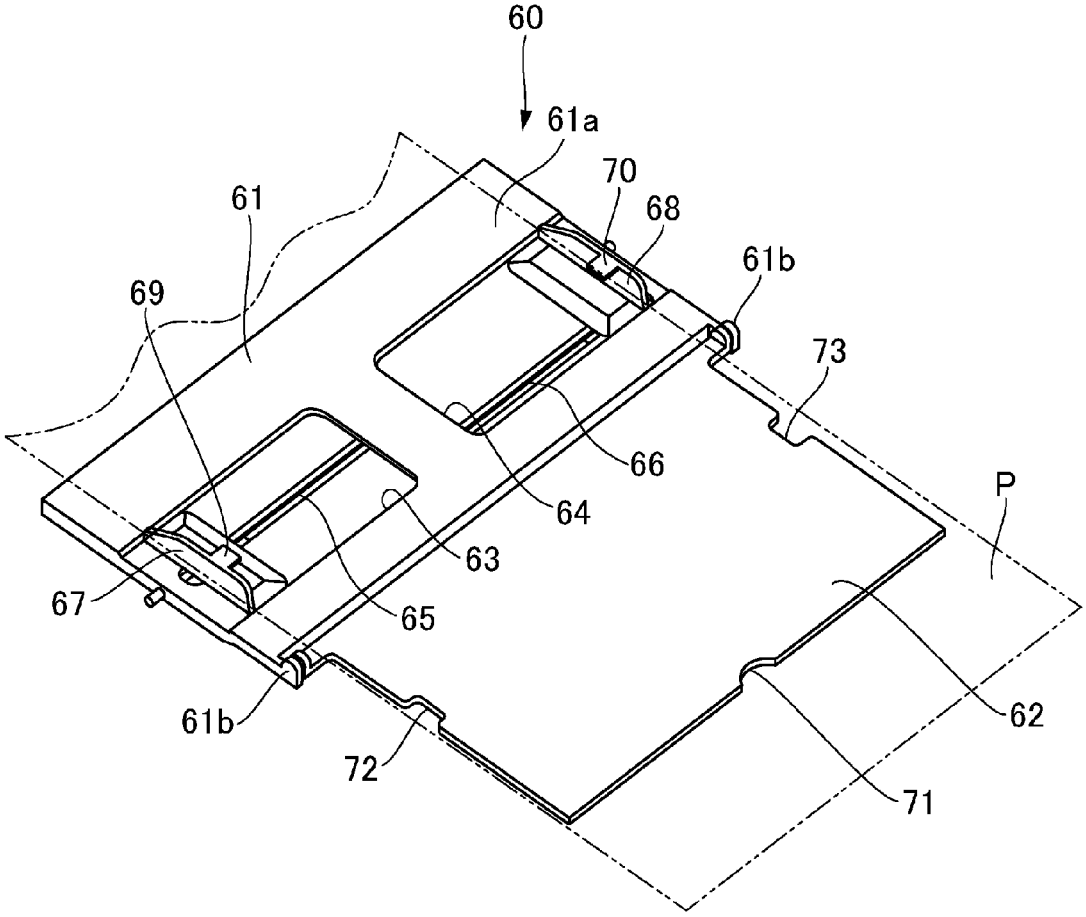
FIG. 3 is a perspective view of the manual feeding tray in a state in which the auxiliary tray is in a second position in First Embodiment.
Figure 4:
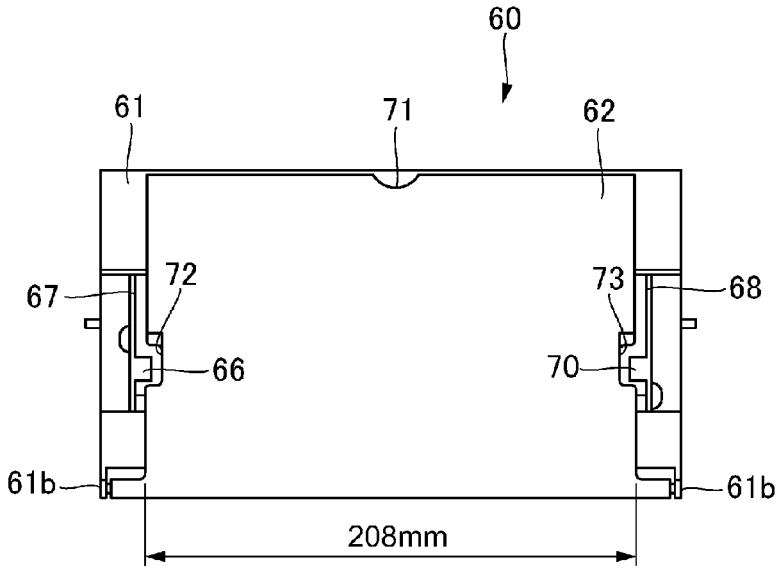
In FIG. 4, (a) and (b) are plan views of the manual feeding tray in First Embodiment, in which (a) shows a state in which the auxiliary tray is in the first position, and (b) shows a state in which the auxiliary tray is in the second position.
Figure 4:
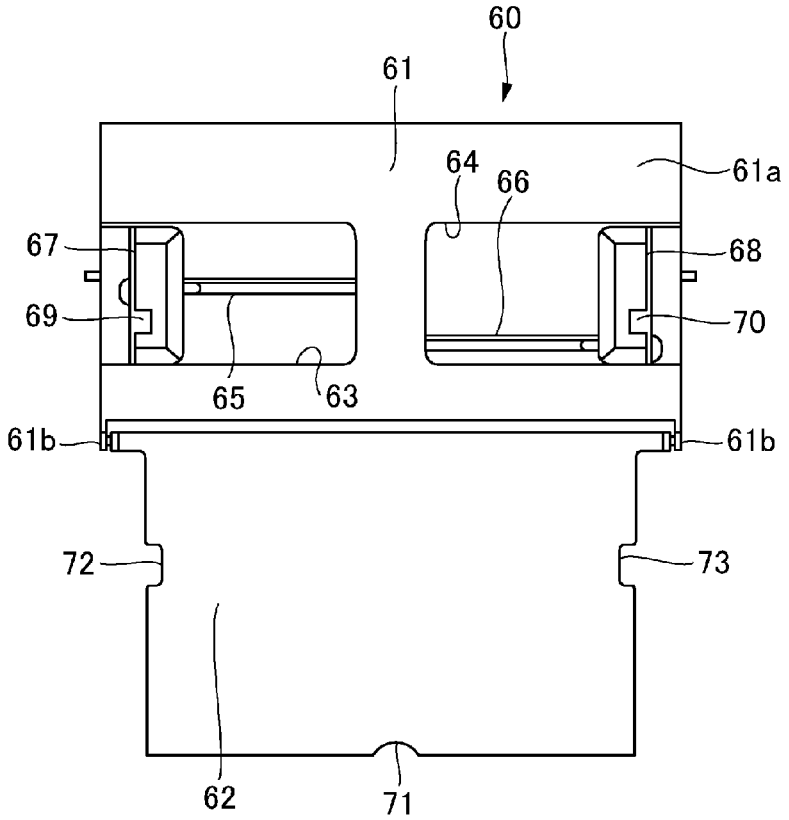

Next, with reference to FIGS. 2 to 4, the manual feeding tray 60 of the manual feeding portion 20 will be described specifically. The manual feeding tray 60 includes, as shown in FIGS. 2 and 3, a main tray 61 (first stacking means) fixed on the feeding door 21, and an auxiliary tray 62 (second stacking means) rotatably supported by the main tray 61. The main tray 61 includes a stacking surface 61*a* on which the sheets P are stacked, and supporting portions 61*b* and 61*b* each projecting from the stacking surface 61*a* in an upstream side of a sheet feeding direction in which the sheet P is fed. The stacking surface 61*a* is an upper surface of the main tray 61 in a state in which the feeding door 21 is open (FIG. 1). A direction perpendicular to the feeding direction of the sheet P stacked on the stacking surface 61*a* is a widthwise direction, and with respect to the widthwise direction, one side on the basis of a center of the stacking surface 61*a* is a left side, and the other side is a right side.

The stacking surface 61*a* is provided with recessed portions 63 and 64 which are formed by partly cutting away the stacking surface 61*a* in left and right sides, and is provided with guiding grooves 65 and 66 each extending in the widthwise direction at these recessed portions 63 and 64, respectively. By the left-side guiding groove 65, a left-side widthwise direction regulating member 67 (first widthwise direction regulating member) for regulating a left-side edge surface of the sheet P stacked on the stacking surface 61*a* is supported movably in the widthwise direction. By the right-side guiding groove 66, similarly, a right-side widthwise direction regulating member 68 (second widthwise direction regulating member) for regulating a right-side edge surface of the sheet P stacked on the stacking surface 61*a* is supported movably in the widthwise direction. That is, the left-side widthwise direction regulating member 67 and the right-side widthwise direction regulating member 68 constitute a widthwise direction regulating means for regulating a position of the sheet P stacked on the stacking surface 61*a* with respect to the widthwise direction, and prevent rotation of the sheet P caused by a sheet feeding operation. These widthwise direction regulating members 67 and 68 are constituted so that they can be guided by the guiding grooves 65 and 66 during movement thereof in the widthwise direction and can be stably moved.

At an upper end portion of the left-side widthwise direction regulating member 67, a left-side height regulating member 69 (first height regulating member) projecting toward a central portion of the stacking surface 61*a* with respect to the widthwise direction (i.e., projecting in the right direction) is provided integrally with the left-side widthwise direction regulating member 67. At an upper end portion of the right-side widthwise direction regulating member 68, a right-side height regulating member 70 (second height regulating member) projecting toward the central portion of the stacking surface 61*a* with respect to the widthwise direction (i.e., projecting in the left direction) is provided integrally with the right-side widthwise direction regulating member 68. These left-side height regulating member 69 and right-side height regulating member 70 constitute a height regulating means for regulating a height of a bundle of the sheets P stacked on the stacking surface 61*a*, and regulate the height of the bundle of the sheets P so that the bundle of the sheets P having a predetermined height or move cannot be stacked on the stacking surface 61*a*. In this embodiment, a size of each of the height regulating members 69 and 70 is 6 mm with respect to the widthwise direction and is 10 mm with respect to the feeding direction and is such that a user recognizes the height regulating members 69 and 70 and can regulate a stacking state of the sheets P.

The auxiliary tray 62 is shaft-supported by the supporting portions 61*b* and 61*b* of the main tray 61 and is provided with a finger-hooking portion 71 formed in an arcuate shape at an end portion in a side opposite from the supporting portions 61*b* and 61*b* with respect to the feeding direction. The user can easily rotate the auxiliary tray 62 in an arrow A direction in FIG. 2 by placing the finger(s) on the finger-hooking portion 71. Further, the auxiliary tray 62 is, as shown in FIG. 4, constituted so that the auxiliary tray 62 can be held at a first position ((a) of FIG. 4) where the auxiliary tray 62 is overlaid on the stacking surface 61*a* of the main tray 61 and a second position ((b) of FIG. 4) where the auxiliary tray 62 is developed toward an upstream side of the feeding direction relative to the main tray 61. In the first position, the sheets P are stacked on the auxiliary tray 62. An upper surface of the auxiliary tray 62 in the second position is provided so as to be substantially flush with the stacking surface 61*a*, and can support the upstream side of the sheets P stacked on the stacking surface 61*a* with respect to the feeding direction. The auxiliary tray 62 in the second position is held by a projected portion 21*a* formed at an upstream end portion of the feeding door 21 in the open state with respect to the feeding direction (FIG. 1).

The auxiliary tray 62 in this embodiment has a performance of supporting sheets having various sizes, but is particularly suitable for the user who uses the auxiliary tray 62 while frequently switch the sheets having a letter size and the sheets having a legal size. The size of the sheets having the letter size is 216 mm with respect to the widthwise direction and 279 mm with respect to the feeding direction and the size of the sheets having the legal size is 216 mm with respect to the widthwise direction and 356 mm with respect to the feeding direction. In order to prevent the auxiliary tray 62 from interfering with the widthwise direction regulating members 67 and 68 for regulating the widthwise direction of these sheets having the letter size and the legal size, a length of the auxiliary tray 62 with respect to the widthwise direction is required to be set at a value less than 216 mm. Further, the auxiliary tray 62 supports, at the second position, the upstream side of the sheets P stacked on the stacking surface 61*a* with respect to the feeding direction, and therefore it is not preferable that the length of the auxiliary tray 62 with respect to the widthwise direction is set at an extremely small value. Therefore, in this embodiment, the length of the auxiliary tray 62 with respect to the widthwise direction is set at 208 mm.

Further, at left and right end portions of the auxiliary tray 62 with respect to the widthwise direction, a left-side cut-away portion 72 and a right-side cut-away portion 73 are formed, respectively. These cut-away portions 72 and 73 are formed in a size such that the cut-away portions 72 and 73 do not interfere with the height regulating members 69 and 70 when the auxiliary tray 62 is rotated from the first position to the second position or from the second position to the first position. Specifically, the size of each of the cut-away portions 72 and 73 is larger than a size of the associated height regulating member 69 or 70, and is 7 mm with respect to the widthwise direction and is 18 mm with respect to the feeding direction. Particularly, the lengths of the cut-away portions 72 and 73 with respect to the feeding direction are made sufficiently larger than those of the height regulating members 69 and 70 so that a rotation locus of the auxiliary tray 62 and the height regulating members 69 and 70 do not interfere with each other. Further, as shown in FIG. 3, the auxiliary tray 62 includes a supporting portion at a position which is different from positions of the cut-away portions 72 and 73 with respect to the feeding direction and which is the same as the positions of the cut-away portions 72 and 73 with respect to the widthwise direction. Further, as is apparent from FIG. 3, the supporting portion of the auxiliary tray 62 is provided upstream of the cut-away portions 72 and 73 with respect to the feeding direction in a state in which the auxiliary tray 62 is in the second position.

The printer 1 in this embodiment is constituted as described above, and therefore in the case where the sheets having the letter size are set on the manual feeding tray 60, the user first disposes the auxiliary tray 62 in the first position where the auxiliary tray 62 is overlaid on the main tray 61. At this time, in the case where the widthwise direction regulating members 67 and 68 are in positions where the widthwise direction regulating members 67 and 68 regulate the sheets having a size smaller than the size of the sheets having the letter size with respect to the widthwise direction, the widthwise direction regulating members 67 and 68 are moved outward until the positions thereof reach positions, between which a width is broader than the width of the letter size, before the auxiliary tray 62 is rotated. Then, the user places the sheets P having the letter size on the auxiliary tray 62 placed in the first position, and then moves the widthwise direction regulating members 67 and 68 to positions between which the width corresponds to the size (216 mm) of the sheets P with respect to the widthwise direction, so that positioning of the sheets P with respect to the widthwise direction is made. As described above, setting of the sheets P having the letter size on the manual feeding tray 60 is completed. Incidentally, in a state in which the auxiliary tray 62 is in the second position, the sheets having the letter size may also be set on the stacking surface 61*a* of the main tray 61.

In the case where the sheets having the legal size longer than the letter size with respect to the feeding direction are set on the manual feeding tray 60, the user develops the auxiliary tray 2 to the second position. For example, in the case where the sheets having the legal size are set in a state changed from the state in which the sheet sharing the letter size are set on the manual feeding tray 60, the user moves the manual feeding tray 60 from the first position to the second position. At this time, the sheets having the letter size and the sheets having the legal size have the same length with respect to the widthwise direction, and therefore the user does not move the widthwise direction regulating members 67 and 68. Further, the length of the auxiliary tray 62 with respect to the widthwise direction is set at a value smaller than the lengths of the sheets having the letter size and the sheets having the legal size, and therefore the auxiliary tray 62 does not interfere with the widthwise direction regulating members 67 and 68 during the rotation of the auxiliary tray 62.

Further, the auxiliary tray 62 is provided with the cut-away portions 72 and 73 formed so that the cut-away portions 72 and 73 are larger than the height regulating members 69 and 70 with respect to the widthwise direction and the feeding direction. For that reason, the auxiliary tray 62 does not interfere with the height regulating members 69 and 70 during the rotation of the auxiliary tray 62. As a result, when the sheets having the letter size and the sheets having the legal size are set on the auxiliary tray 62 by being alternately switched, the auxiliary tray 62 can be easily rotated, so that operativity can be improved. Further, the user stacks the sheets P on the stacking surface 61*a* of the main tray 61 and the auxiliary tray 62 placed in the second position, so that the setting of the sheets having the legal size on the manual feeding tray 60 is completed.

In the case where the height regulating members 69 and 70 constitute an obstacle to stacking of the sheets P when the sheets P are stacked, the user may also move the height regulating members 69 and 70 by a predetermined distance. Also in the case where the auxiliary tray 62 is rotated from the second position to the first position from a state in which the sheets having the legal size are set on the manual feeding tray 60, the auxiliary tray 62 does not interfere with the height regulating members 69 and 70.

In this embodiment, an example in which operativity of the manual feeding tray 60 is most improved for the user who uses the manual feeding tray 60 while switching the sheets having the letter size and the sheets having the legal size is shown, but the present invention is not limited thereto. That is, also sheets having other sizes can achieve a similar effect in the case where the sheets having different sizes such that lengths of the sheets stacked on the manual feeding tray 60 are the same with respect to the widthwise direction and are different from each other with respect to the sheet feeding direction are used.

Second Embodiment

Figure 5:
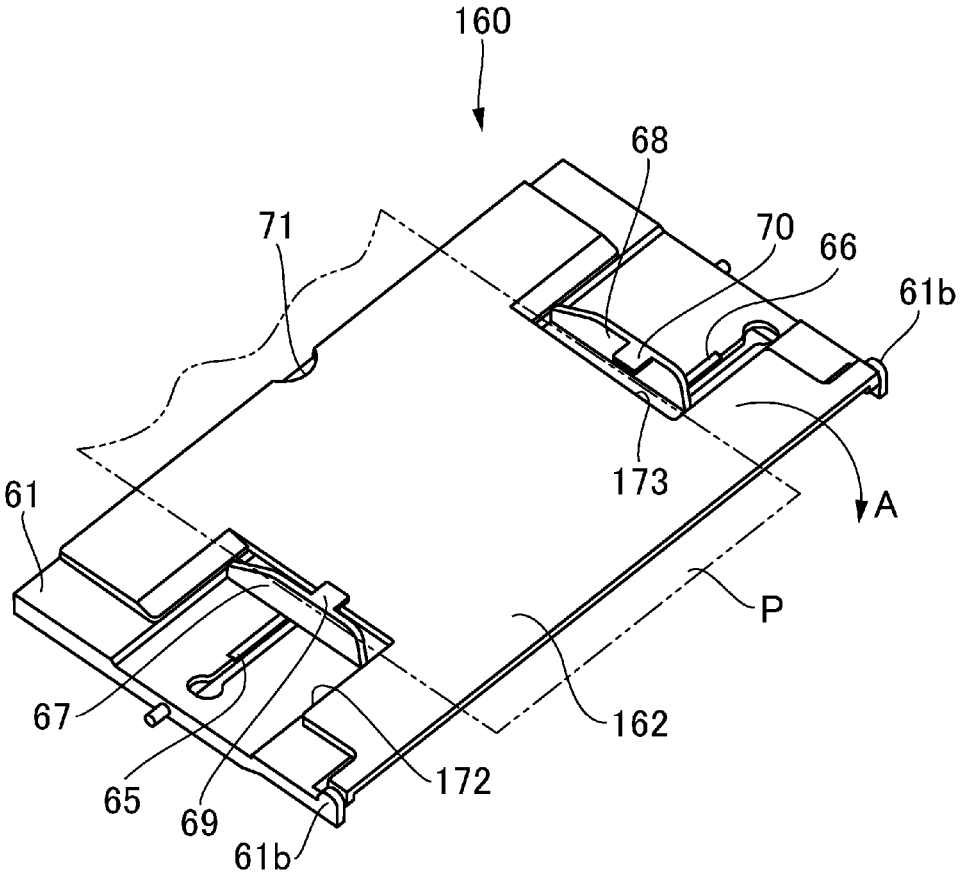
FIG. 5 is a perspective view of a manual feeding tray in a state in which an auxiliary tray is in a first position in Second Embodiment of the present invention.
Figure 6:
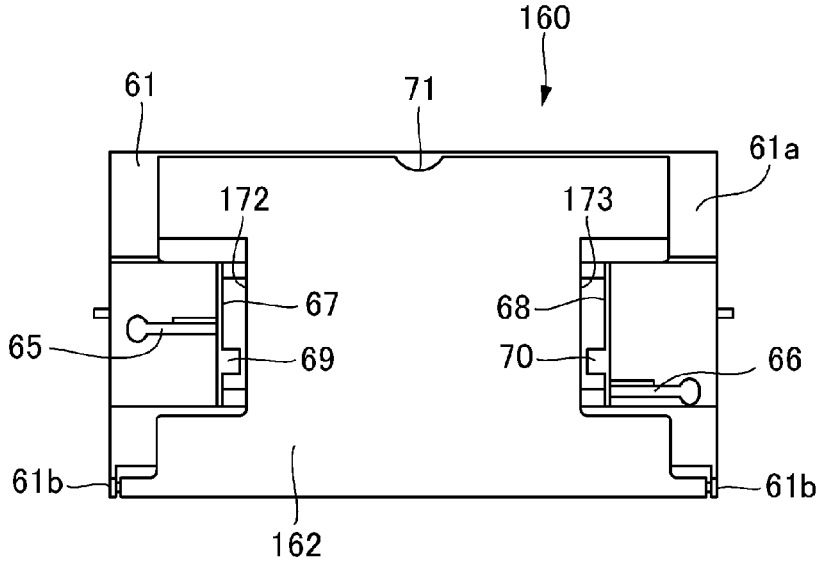
In FIG. 6, (a) and (b) are plan views of the manual feeding tray in Second Embodiment, in which (a) shows a state in which the auxiliary tray is in the first position, and (b) shows a state in which the auxiliary tray is in a second position.
Figure 6:
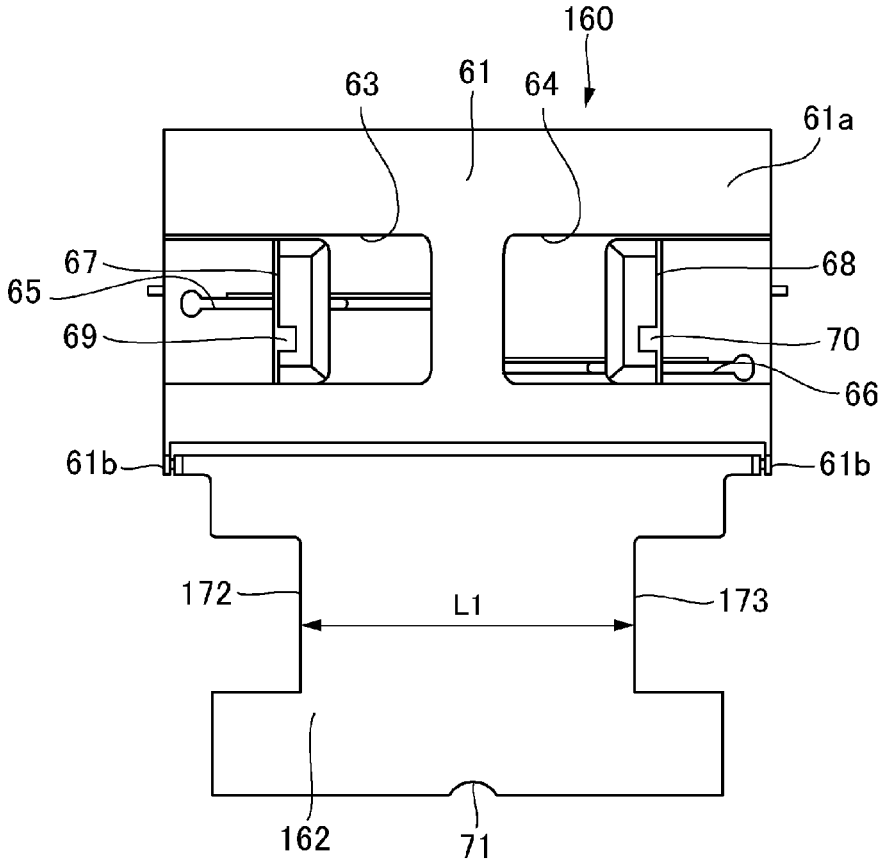

Second Embodiment of the present invention will be described, but constituent elements similar to those in First Embodiment will be omitted from illustration or will be omitted from description by adding the same reference numerals or symbols to the constituent elements in the figures. A manual feeding tray 160 includes, as shown in FIG. 5, the main tray 61 fixed on the feeding door 21, and an auxiliary tray 162 (second stacking means) shaft-supported by the supporting portions 61*b* and 61*b* of the main tray 61. The user places the finger(s) on the finger-hooking portion 71, so that the auxiliary tray 162 can be easily rotated in an arrow A direction in FIG. 5. Further, the auxiliary tray 162 is, as shown in FIG. 6, constituted so that the auxiliary tray 162 can be held at a first position ((a) of FIG. 6) where the auxiliary tray 162 is overlaid on the stacking surface 61*a* of the main tray 61 and a second position ((b) of FIG. 6) where the auxiliary tray 162 is developed toward an upstream side of the feeding direction relative to the main tray 61.

The auxiliary tray 162 in this embodiment has a performance of supporting sheets having various sizes, but is particularly suitable for the user who uses a plurality of sheets having different length with respect to the widthwise direction, ranging in size from a letter size to an A5 size. The size of the sheets having the A5 size is 148.5 mm with respect to the widthwise direction and 210 mm with respect to the feeding direction.

At left and right end portions of the auxiliary tray 162 with respect to the widthwise direction, a left-side cut-away portion 172 and a right-side cut-away portion 173 are formed, respectively. These cut-away portions 172 and 173 are formed in a size such that the cut-away portions 172 and 173 do not interfere with the widthwise direction regulating members 67 and 68 for regulating the widthwise direction of the sheets ranging in size from the letter size to the A5 size the height regulating members 69 and 70 when the auxiliary tray 162 is rotated.

Specifically, the length of each of the cut-away portions 172 and 173 with respect to the feeding direction is larger than a length of the associated feeding direction regulating member 67 or 68 by a predetermined amount. A length of each of the cut-away portions 172 and 173 with respect to the widthwise direction is set by a width L1 ((b) of FIG. 6) between central end portions of these cut-away portions 172 and 173 with respect to the widthwise direction. This width L1 is set at 134 mm smaller than a numerical value (134.5 mm) obtained by subtracting a length (7 mm) of each of the height regulating members 69 and 70 with respect to the widthwise direction from the length (148.5 mm) of the A5-sized sheet with respect to the widthwise direction.

Incidentally, as shown in FIG. 5, an upstream end portion of each of the widthwise direction regulating member 67 and 68 with respect to the feeding direction may also be formed so as to taper down toward the upstream end. As a result, even when the lengths of the cut-away portions 172 and 173 with respect to the feeding direction are made substantially equal to the length of the widthwise direction regulating members 67 and 68 with respect to the feeding direction, it is possible to prevent the widthwise direction regulating members 67 and 68 from interfering with the auxiliary tray 162 during the rotation of the auxiliary tray 162.

The manual feeding tray 160 in this embodiment is constituted as described above, and therefore in the case where the sheets having the A5 size are set on the manual feeding tray 160, the user first disposes the auxiliary tray 162 in the first position where the auxiliary tray 162 is overlaid on the main tray 61. At this time, in the case where the widthwise direction regulating members 67 and 68 are in positions where the widthwise direction regulating members 67 and 68 regulate the sheets having a size smaller than the size of the sheets having the A5 size with respect to the widthwise direction, the widthwise direction regulating members 67 and 68 are moved outward until the positions thereof reach positions, between which a width is broader than the width of the A5 size, before the auxiliary tray 162 is rotated.

Then, the user places the sheets P having the A5 size on the auxiliary tray 162 placed in the first position, and then moves the widthwise direction regulating members 67 and 68 to positions between which the width corresponds to the length (148.5 mm) of the sheets P with respect to the widthwise direction, so that positioning of the sheets P with respect to the widthwise direction is made. As described above, setting of the sheets P having the letter size on the manual feeding tray 160 is completed. At this time, the lengths of the cut-away portions 172 and 173 with respect to the feeding direction are set so as to be larger than the lengths of the widthwise direction regulating members 67 and 68 with respect to the feeding direction. Further, the width L1 set by the length between the cut-away portions 172 and 173 with respect to the widthwise direction is set so as to be smaller than the length of the A5-sized sheet with respect to the widthwise direction. For that reason, even the auxiliary tray 162 is in the first position, the widthwise direction regulating members 67 and 68 can be moved in an entire movable range in which the sheets ranging in size from the letter size to the A5 size are regulated, so that operativity is good.

Further, e.g., in a state in which the auxiliary tray 162 is in the second position, the case where the widthwise direction regulating members 67 and 68 are set, before the sheets P are stacked, in a position where the widthwise direction of the A5-sized sheets P is regulated in assumed. In that case, the auxiliary tray 162 placed in the second position is moved to the first position and then the A5-sized sheets P are stacked on the auxiliary tray 162 moved to the first position, so that setting of the sheets is completed. At that time, the width L1 is set at the value obtained by subtracting the lengths of the height regulating members 69 and 70 with respect to the widthwise direction from the length of the A5-sized sheets with respect to the widthwise direction. For that reason, when the user rotates the auxiliary tray 162 from the second position to the first position, the auxiliary tray 162 does not interfere with the height regulating members 69 and 70. Incidentally, in the state in which the auxiliary tray 162 is in the second position, the A5-sized sheets may also be set on the stacking surface 61*a* of the main tray 61.

Further, the lengths of the cut-away portions 172 and 173 with respect to the feeding direction are made larger than the lengths of the widthwise direction regulating members 67 and 68 with respect to the feeding direction by the predetermined amount. For that reason, when the user rotates the auxiliary tray 162 from the second position to the first position, the auxiliary tray 162 does not interfere with the widthwise direction regulating members 67 and 68. Naturally, also in the case where the auxiliary tray 162 is rotated from the first position to the second position, the auxiliary tray 162 does not interfere with the widthwise direction regulating members 67 and 68 and the height regulating members 69 and 70.

Further, even when the widthwise direction regulating members 68 and 69 are in positions where the widthwise direction regulating members 68 and 69 regulate the widthwise direction of the sheets having a size larger than the A5 size with respect to the widthwise direction, the auxiliary tray 162 does not interfere with the widthwise direction regulating members 67 and 68 and the height regulating members 69 and 70. As a result, when the sheets ranging in size from the letter size to the A5 size are set on the manual feeding tray 160, the auxiliary tray 162 can be easily rotated, so that the operativity can be improved.

Third Embodiment

Figure 7:
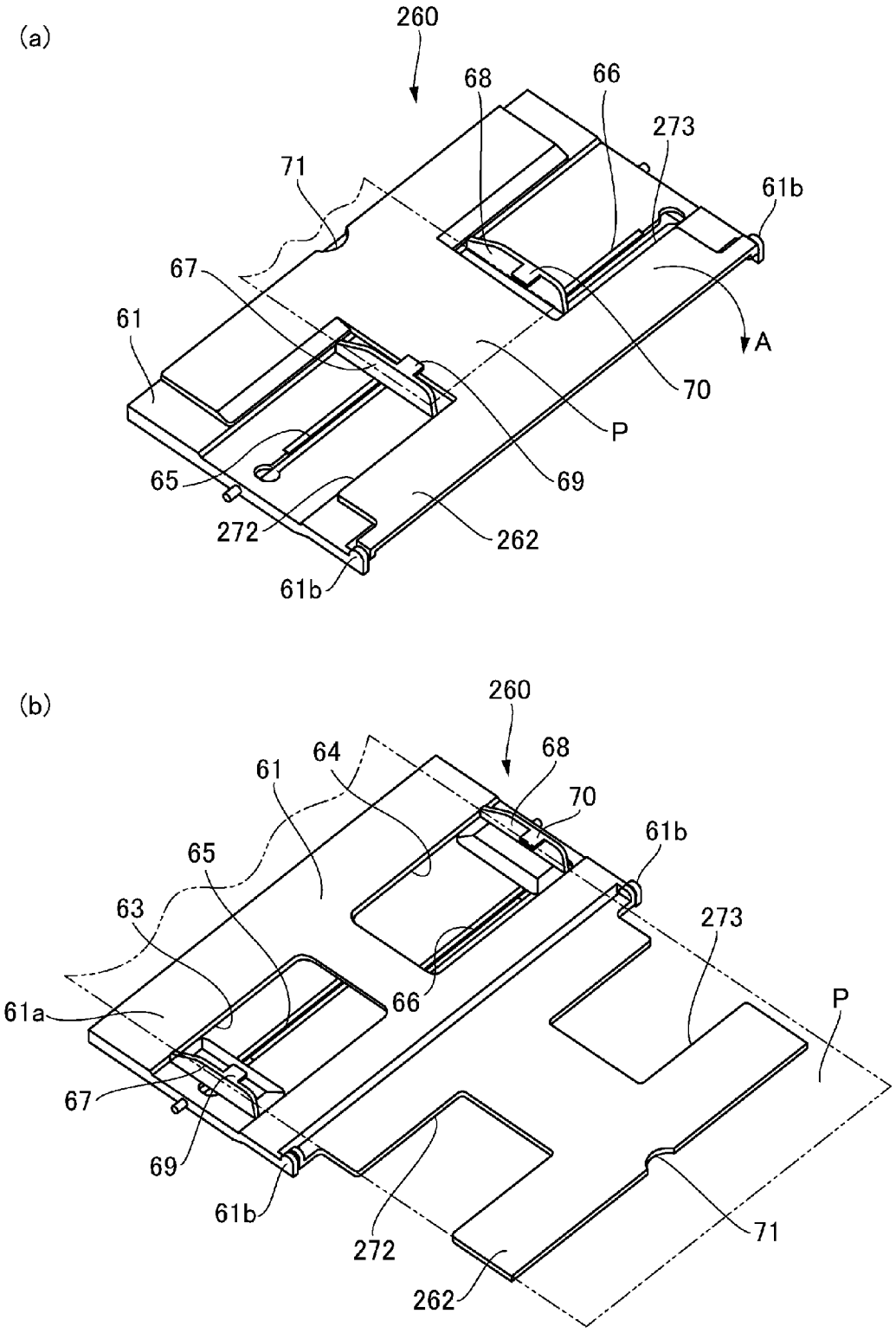
In FIG. 7, (a) and (b) are perspective views of an manual feeding tray in Third Embodiment, in which (a) shows a state in which an auxiliary tray is in a first position, and (b) shows a state in which the auxiliary tray is in a second position.
Figure 8:
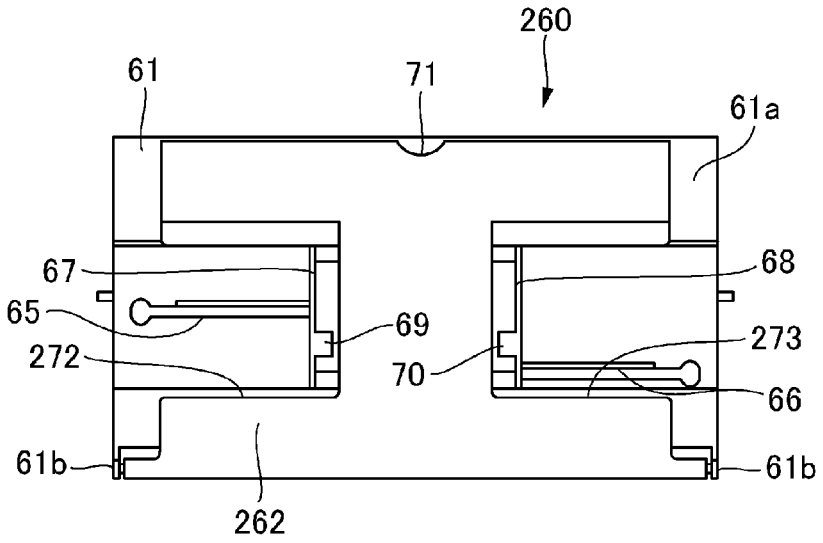
In FIG. 8, (a) and (b) are plan views of the manual feeding tray in Third Embodiment, in which (a) shows the state in which the auxiliary tray is in the first position, and (b) shows the state in which the auxiliary tray is in the second position.
Figure 8:
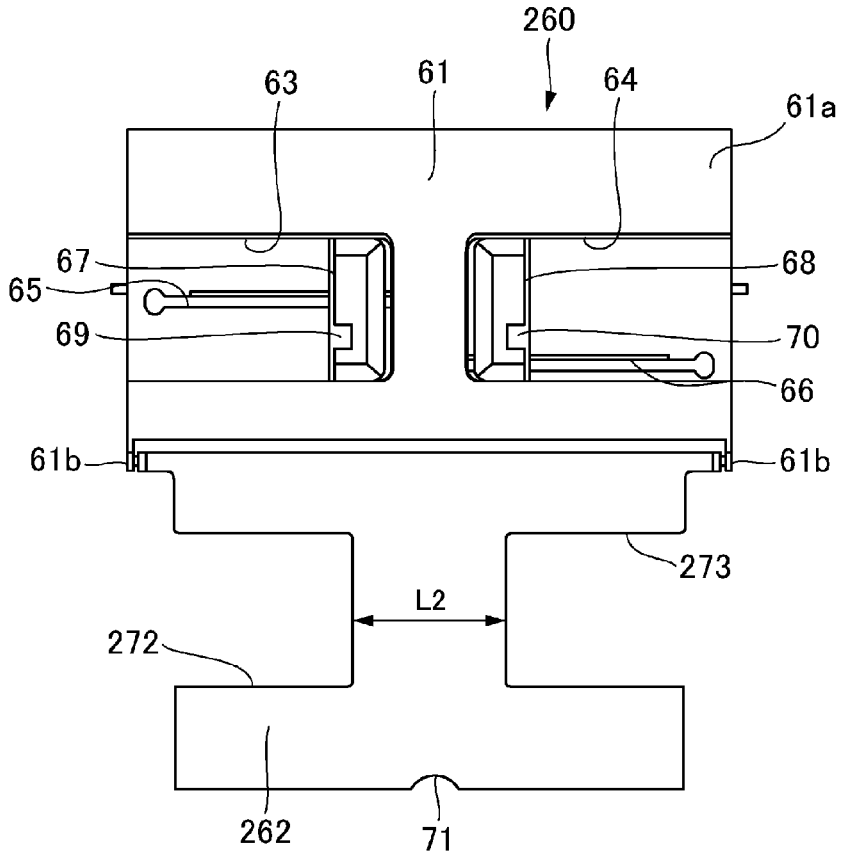

Third Embodiment of the present invention will be described, but constituent elements similar to those in First Embodiment will be omitted from illustration or will be omitted from description by adding the same reference numerals or symbols to the constituent elements in the figures. A manual feeding tray 260 includes, as shown in FIG. 7, the main tray 61 fixed on the feeding door 21, and an auxiliary tray 262 (second stacking means) shaft-supported by the supporting portions 61*b* and 61*b* of the main tray 61. The user places the finger(s) on the finger-hooking portion 71, so that the auxiliary tray 262 can be easily rotated in an arrow A direction in FIG. 7. Further, the auxiliary tray 262 is, as shown in FIG. 8, constituted so that the auxiliary tray 262 can be held at a first position ((a) of FIG. 8) where the auxiliary tray 262 is overlaid on the stacking surface 61*a* of the main tray 61 and a second position ((b) of FIG. 8) where the auxiliary tray 162 is developed toward an upstream side of the feeding direction relative to the main tray 61.

The auxiliary tray 262 in this embodiment has a performance of supporting sheets having various sizes, but is particularly suitable for the user who uses a plurality of sheets having different length with respect to the widthwise direction, ranging in size from a legal size to a card size. The length of the sheets having the card size is 3 inch=76.2 mm with respect to the widthwise direction.

At left and right end portions of the auxiliary tray 262 with respect to the widthwise direction, a left-side cut-away portion 272 and a right-side cut-away portion 273 are formed, respectively. These cut-away portions 272 and 273 are formed in a size such that the cut-away portions 272 and 273 do not interfere with the widthwise direction regulating members 67 and 68 for regulating the widthwise direction of the sheets ranging in size from the legal size to the card size the height regulating members 69 and 70 when the auxiliary tray 262 is rotated.

Specifically, the length of each of the cut-away portions 272 and 273 with respect to the feeding direction is larger than a length of the associated feeding direction regulating member 67 or 68 by a predetermined amount. A length of each of the cut-away portions 272 and 273 with respect to the widthwise direction is set by a width L2 ((b) of FIG. 8) between central end portions of these cut-away portions 272 and 273 with respect to the widthwise direction. This width L2 is set at 62 mm smaller than a numerical value (62.2 mm) obtained by subtracting a length (7 mm) of each of the height regulating members 69 and 70 with respect to the widthwise direction from the length (76.2 mm) of the A5-sized sheet with respect to the widthwise direction. The auxiliary tray 262 is constituted by a resin material in order to maintain strength and rigidity.

The manual feeding tray 260 in this embodiment is constituted as described above, and therefore in the case where the sheets having the card size are set on the manual feeding tray 260, the user first disposes the auxiliary tray 262 in the first position where the auxiliary tray 262 is overlaid on the main tray 61. At this time, in the case where the widthwise direction regulating members 67 and 68 are in positions where the widthwise direction regulating members 67 and 68 regulate the sheets having a size smaller than the size of the sheets having the card size with respect to the widthwise direction, the widthwise direction regulating members 67 and 68 are moved outward until the positions thereof reach positions, between which a width is broader than the width of the A5 size, before the auxiliary tray 262 is rotated.

Then, the user places the sheets P having the card size on the auxiliary tray 262 placed in the first position, and then moves the widthwise direction regulating members 67 and 68 to positions between which the width corresponds to the length (76.2 mm) of the sheets P with respect to the widthwise direction, so that positioning of the sheets P with respect to the widthwise direction is made. As described above, setting of the sheets P having the letter size on the manual feeding tray 260 is completed. At this time, the lengths of the cut-away portions 272 and 273 with respect to the feeding direction are set so as to be larger than the lengths of the widthwise direction regulating members 67 and 68 with respect to the feeding direction. Further, the width L2 set by the length between the cut-away portions 272 and 273 with respect to the widthwise direction is set so as to be smaller than the length of the card-sized sheet with respect to the widthwise direction. For that reason, even the auxiliary tray 262 is in the first position, the widthwise direction regulating members 67 and 68 can be moved in an entire movable range in which the sheets ranging in size from the legal size to the card size are regulated, so that operativity is good.

Further, e.g., in a state in which the auxiliary tray 162 is in the second position, the case where the widthwise direction regulating members 67 and 68 are set, before the sheets P are stacked, in a position where the widthwise direction of the card-sized sheets P is regulated in assumed. In that case, the auxiliary tray 262 placed in the second position is moved to the first position and then the card-sized sheets P are stacked on the auxiliary tray 262 moved to the first position, so that setting of the sheets is completed. At that time, the width L2 is set at the value obtained by subtracting the lengths of the height regulating members 69 and 70 with respect to the widthwise direction from the length of the card-sized sheets with respect to the widthwise direction. For that reason, when the user rotates the auxiliary tray 262 from the second position to the first position, the auxiliary tray 262 does not interfere with the height regulating members 69 and 70.

Further, the lengths of the cut-away portions 272 and 273 with respect to the feeding direction are made larger than the lengths of the widthwise direction regulating members 67 and 68 with respect to the feeding direction by the predetermined amount. For that reason, when the user rotates the auxiliary tray 262 from the second position to the first position, the auxiliary tray 262 does not interfere with the widthwise direction regulating members 67 and 68. Naturally, also in the case where the auxiliary tray 262 is rotated from the first position to the second position, the auxiliary tray 262 does not interfere with the widthwise direction regulating members 67 and 68 and the height regulating members 69 and 70. Incidentally, in the state in which the auxiliary tray 262 is in the second position, the card-sized sheets may also be set on the stacking surface 61*a* of the main tray 61.

Further, even when the widthwise direction regulating members 68 and 69 are in positions where the widthwise direction regulating members 68 and 69 regulate the widthwise direction of the sheets having a size larger than the card size with respect to the widthwise direction, the auxiliary tray 262 does not interfere with the widthwise direction regulating members 67 and 68 and the height regulating members 69 and 70. As a result, when the sheets ranging in size from the legal size to the card size are set on the manual feeding tray 260, the auxiliary tray 262 can be easily rotated, so that the operativity can be improved.

In the case where the sheets having the legal size long in the feeding direction are set on the manual feeding tray 260, the user develops the auxiliary tray 262 to the second position. At that time, as described above, even when the widthwise direction regulating members 67 and 68 are in positions where the widthwise direction regulating members 67 and 68 regulate the widthwise direction of the sheets having the card size, the auxiliary tray 262 does not interfere with the widthwise direction regulating members 67 and 68 and the height regulating members 69 and 70 during the rotation thereof from the first position to the second position. Next, the user moves the widthwise direction regulating members 67 and 68 to positions where a length between the widthwise direction regulating members 67 and 68 with respect to the widthwise direction is larger than the length of the legal-sized sheet with respect to the widthwise direction, and then the sheets P having the legal size are stacked on the stacking surface 61*a* of the main tray 61 and the auxiliary tray 262 rotated to the second position. Then, the user moves the widthwise direction regulating members 67 and 68 to position the sheets P with respect to the widthwise direction, so that setting of the sheets P having the legal size is completed.

In First to Third Embodiments described above, the first widthwise direction regulating member is the left-side widthwise direction regulating member and the second widthwise direction regulating member is the right-side widthwise direction regulating member, but may also be reversed. Similarly, the first height regulating member may also be the right-side height member and the second height regulating member may also be the left-side height regulating member.

Further, in First to Third Embodiments described above, as the height regulating means, the two members consisting of the left-side height regulating member and the right-side height regulating member are used, but a single height regulating member or three or more height regulating members may also be used. Further, these height regulating means may also be provided so that the left-side height regulating member and the right-side height regulating member are disposed as separate members. In either case, the operativity of the manual feeding tray can be improved by forming the cut-away portions so as not to interfere with the associated height regulating means during the rotation of the auxiliary tray.

In the present invention, the second stacking means rotatably supported by the first stacking means is provided with the cut-away portions, and therefore when the second stacking means is rotated, the second stacking means is prevented from interfering with the widthwise direction regulating means or the height regulating means. As a result, latitude of rotation of the second stacking means is improved, so that the operativity can be improved.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-076286 filed on Apr. 2, 2014, which is hereby incorporated by reference herein in its entirety.

What is claimed is:

1. A stacking device for stacking a sheet fed by a sheet feeding unit, comprising:

a first stacking portion having a stacking surface on which the sheet is stacked;

a widthwise direction regulating unit, provided movable relative to said first stacking portion in a widthwise direction of the sheet, for regulating a widthwise position of the sheet stacked on the stacking surface;

a second stacking portion provided rotatable relative to said first stacking portion between a first position and a second position, wherein said second stacking portion is overlaid on said first stacking portion at the first position and supports, at the second position, an upstream portion of the sheet with respect to a feeding direction of the sheet fed by the sheet feeding unit, wherein said second stacking portion includes a first end portion and a second end portion, in one side with respect to the widthwise direction, for constituting an end surface of said second stacking portion and for supporting the sheet and includes a recessed portion between said first end portion and said second end portion with respect to the feeding direction, and wherein said recessed portion is recessed inwardly from said first end portion and said second end portion with respect to the widthwise direction and is in non-contact with said widthwise direction regulating unit when said second stacking portion rotates between the first position and the second position.

2. A stacking device according to claim 1, wherein said widthwise direction regulating unit is movable in the widthwise direction, and a position where said widthwise direction regulating unit is positioned in an outermost side with respect to the widthwise direction is the predetermined direction.

3. A stacking device according to claim 1, wherein said widthwise direction regulating unit includes a first widthwise direction regulating member provided on the stacking surface in one side with respect to the widthwise direction and a second widthwise direction regulating member provided on the stacking surface in the other side with respect to the widthwise direction, and wherein said recessed portion is provided in each of sides of said second stacking portion with respect to the widthwise direction to avoid interference with said first widthwise direction regulating member and said second widthwise direction regulating member.

4. A stacking device according to claim 1, wherein said widthwise direction regulating unit includes a height regulating member for regulating a height of the sheet with respect to a height direction, and said recessed portion is provided to avoid interference with said height regulating member.

5. A stacking device according to claim 1, wherein said widthwise direction regulating unit includes a contact portion contacting an end portion of the sheet with respect to the widthwise direction.

6. A stacking device according to claim 4, wherein said height regulating portion projects from said widthwise direction regulating unit toward a central side of said stacking surface with respect to the widthwise direction.

7. A stacking device according to claim 1, wherein said second stacking portion includes a supporting portion for supporting the sheet at a position which is different from a position of said recessed portion with respect to the feeding direction and which is the same as the position of said recessed portion with respect to the widthwise direction.

8. A stacking device according to claim 7, wherein said supporting portion is provided upstream of said recessed portion with respect to the feeding direction in a state in which said second stacking portion is in the second position.

9. An image forming apparatus comprising:

ing device according to claim 1; and an image forming unit for forming an image on a sheet stacked on said stacking device.

* * * * *